US009216748B2

(12) United States Patent
Xu et al.

(10) Patent No.: US 9,216,748 B2
(45) Date of Patent: Dec. 22, 2015

(54) BOGIE AND SIDE FRAME THEREOF

(71) Applicant: Qiqihar Railway Rolling Stock Co., Ltd., Heilongjiang (CN)

(72) Inventors: Shifeng Xu, Heilongjiang (CN); Wendong Shao, Heilongjiang (CN); Haibin Hu, Heilongjiang (CN); Yuebin Yu, Heilongjiang (CN); Pingwei Yin, Heilongjiang (CN); Zhenming Liu, Heilongjiang (CN)

(73) Assignee: Qiqihar Railway Rolling Stock Co., Ltd. (CN)

( * ) Notice: Subject to any disclaimer, the term of this patent is extended or adjusted under 35 U.S.C. 154(b) by 190 days.

(21) Appl. No.: 14/000,343

(22) PCT Filed: Mar. 21, 2013

(86) PCT No.: PCT/CN2013/072987

§ 371 (c)(1),
(2) Date: Aug. 19, 2013

(87) PCT Pub. No.: WO2014/094393

PCT Pub. Date: Jun. 26, 2014

(65) Prior Publication Data

US 2014/0165871 A1 Jun. 19, 2014

(30) Foreign Application Priority Data

Dec. 19, 2012 (CN) ..... 2012 1 0555967

(51) Int. Cl.
*B61F 5/00* (2006.01)
*B61F 5/52* (2006.01)

(52) U.S. Cl.
CPC ..... *B61F 5/52* (2013.01)

(58) Field of Classification Search
CPC ..... B61F 3/02; B61F 5/00; B61F 5/52; B61F 5/30; B61F 5/24; B61F 5/40; B61F 5/38; B61F 5/50
See application file for complete search history.

(56) References Cited

U.S. PATENT DOCUMENTS 4,111,131 A * 9/1978 Bullock ..... 105/224.1
4,300,454 A * 11/1981 Scheffel ..... 105/168

(Continued)

FOREIGN PATENT DOCUMENTS

AU 748598 6/2002
CN 2230260 Y 7/1996

(Continued)

OTHER PUBLICATIONS

Canadian Office Action for Canadian Application No. 2,814,936 dated Oct. 3, 2014.

*Primary Examiner* — Jason C Smith
(74) *Attorney, Agent, or Firm* — Patterson Thuente Pedersen, P.A.

(57) ABSTRACT

A side frame for a bogie. Two longitudinal sides of the side frame are respectively provided with a supporting seat for connecting an end portion of a connecting rod, and the supporting seat is integrally formed with the side frame by casting. The supporting seat includes a supporting plate, a middle rib and a first side rib. The supporting plate is provided with a through hole. The connecting rod and the supporting seat are thread-connected via a conical pole which is fixedly provided in the through hole. The side frame reduces the welding processes, ensures the installation precision of the supporting seat, and enhances the strength of the supporting seat.

12 Claims, 3 Drawing Sheets

(56) References Cited

U.S. PATENT DOCUMENTS

| | | | | | |
|---|---|---|---|---|---|
| 4,628,824 | A * | 12/1986 | Goding et al. | 105/168 |
| 5,243,920 | A * | 9/1993 | Lamson et al. | 105/165 |
| 5,461,986 | A * | 10/1995 | Sarnicki et al. | 105/165 |
| 5,579,696 | A * | 12/1996 | Berg | 105/206.1 |
| 5,584,250 | A * | 12/1996 | Berg | 105/182.1 |
| 5,588,367 | A * | 12/1996 | Scheffel | 105/168 |
| 5,609,109 | A * | 3/1997 | Berg | 105/206.1 |
| 5,832,838 | A * | 11/1998 | Shaw | 105/206.2 |
| 6,176,369 | B1 * | 1/2001 | Petrovic | 198/867.11 |
| 6,357,360 | B1 * | 3/2002 | Arnswald et al. | 105/182.1 |
| 7,603,954 | B2 * | 10/2009 | Forbes | 105/197.05 |
| 8,336,464 | B1 * | 12/2012 | Xing et al. | 105/168 |
| 8,474,383 | B1 * | 7/2013 | Berg et al. | 105/208 |
| 2003/0226471 | A1 * | 12/2003 | Cummings | 105/185 |
| 2004/0020400 | A1 * | 2/2004 | Cummings | 105/4.1 |
| 2011/0247520 | A1 * | 10/2011 | Liu et al. | 105/197.05 |
| 2013/0255532 | A1 * | 10/2013 | Liu et al. | 105/182.1 |
| 2014/0165871 | A1 * | 6/2014 | Xu et al. | 105/206.1 |

FOREIGN PATENT DOCUMENTS

| | | | |
|---|---|---|---|
| CN | 2388083 | | 7/2000 |
| CN | 2910705 | | 6/2007 |
| CN | 2910705 | Y | 6/2007 |
| CN | 201058610 | Y | 5/2008 |
| CN | 101332825 | | 12/2008 |
| CN | 101700775 | A | 5/2010 |
| CN | 101837792 | B | 9/2010 |
| CN | 201808569 | | 4/2011 |
| CN | 201808569 | U | 4/2011 |
| CN | 201901156 | U | 7/2011 |
| GB | 2 123 773 | A | 2/1984 |
| RU | 2 297 350 | C1 | 4/2007 |
| SU | 1577689 | A3 | 7/1990 |

* cited by examiner

BOGIE AND SIDE FRAME THEREOF

The present application is a National Phase entry of PCT Application No. PCT/CN2013/072987, filed Mar. 21, 2013, which application claims the benefit of priority to Chinese Patent Application No. 201210555967.7, filed with the Chinese State Intellectual Property Office on Dec. 19, 2012 and entitled "BOGIE AND SIDE FRAME THEREOF", the entire disclosures of which are incorporated herein by reference.

FIELD OF THE INVENTION

The present application relates to the field of transportation facilities, and particularly to a bogie and a side frame thereof.

BACKGROUND OF THE INVENTION

The bogie is one of the most important components in the structure of the railway vehicle, it is mainly used to increase the carrying capacity, the length and the volume of the vehicle, and to increase the speed of the vehicle, such that the vehicle can have a good operation quality when it is run at a low or high speed under a specified railway track so as to protect the vehicle and the goods, satisfying requirements for the development of railway transportation. The bogie may be divided into a frame type bogie, a quasi-frame type bogie and a three-piece bogie in terms of the load transforming manner between the vehicle body and the bogie.

Referring to FIGS. 1 to 3, FIG. 1 and FIG. 2 are a front view and a top view of a side frame of a three-piece bogie in the prior art, respectively; and FIG. 3 is a structural schematic view of a supporting seat in FIG. 1. Operation processes of the above bogie and its drawbacks will be briefly explained hereinafter.

In the prior art, as shown in FIGS. 1 to 3, the above side frame is applicable to a central cross-braced bogie, that is, the bogie includes a first connecting rod and a second connecting rod passed through holes provided on two sides of the abdominal portion of the bolster in a cross manner, and each of two side frames thereof is symmetrically provided with two supporting seats 1'. During the operation, the two supporting seats 1' of the first side frame are connected to the first end of the first connecting rod and the first end of the second connecting rod, respectively, and the two supporting seats 1' of the second side frame are connected to the second end of the first connecting rod and the second end of the second connecting rod, respectively, so as to form the central cross-bracing structure and avoid a parallelogram phenomenon among the two side frames and two pairs of wheels. Therefore, the curving performance is improved and the critical speed of the hunting motion is increased.

However, the supporting seat 1' on the above side frame includes a supporting plate 11' which is arranged horizontally and a first vertical plate 12' and a second vertical plate 13' which are arranged vertically. The three plates are welded onto the side frame after being welded together. This kind of side frame has a high requirement on the welding process and a high dependence on the welding quality. A large deformation may be caused by welding, which generally results in a low installation precision of the side frame, and thus a poor strength of the side frame, which thereby affects the motion reliability of the bogie.

In view of the technical drawbacks in the prior art, there is an urgent demand to further improve the side frame of the bogie to increase the installation precision of the side frame and enhance the motion reliability of the bogie.

SUMMARY OF THE INVENTION

An object of the present application is to provide a side frame for a bogie so as to increase the installation precision of the side frame and enhance the motion reliability of the bogie. On basis of this, another object of the present application is to provide a bogie having the side frame.

In order to solve the above technical problem, it is provided according to the present application a side frame for a bogie. The bogie includes a bolster provided between two side frames. The bogie further includes two connecting rods passed through holes on two sides of an abdominal portion of the bolster in a cross manner. Two longitudinal sides of each side frame are respectively provided with a supporting seat for connecting an end portion of the connecting rod, and the supporting seat is integrally formed with the side frame by casting. The supporting seat includes a supporting plate, a middle rib provided underneath a middle portion of the supporting plate, and a first side rib provided underneath a longitudinal inner side of the supporting plate. The supporting plate is provided, on a middle portion thereof, with a through hole. The connecting rod and the supporting seat are thread-connected via a conical pole which is fixedly provided in the through hole.

Preferably, the supporting plate is tapered along its length from its root portion to its end portion; and the first side rib has the same extending direction as that of a longitudinal inner side of the supporting plate, and is supported under an edge of the longitudinal inner side of the supporting plate.

Preferably, the extending direction of the longitudinal inner side of the supporting plate and the extending direction of the first side rib are parallel with a direction of the connecting rod connected to the supporting seat.

Preferably, the end portion of the supporting plate is provided with a round plate, and the through hole is provided on the round plate.

Preferably, a bottom surface of the middle rib and a bottom surface of the first side rib are inclined surfaces.

Preferably, the supporting seat is provided at a transverse outer side or a transverse inner side of the side frame, or is provided at an upper side or a lower side of the side frame.

Preferably, the bogie further includes a cross beam extended across the two side frames, and an upper end portion of each side frame is provided with a bracket which is connected to an end portion of the cross beam.

Preferably, the bracket includes a horizontal plate and vertical plates provided at two sides of the horizontal plate, and the bracket is integrally formed with the side frame by casting.

The present application provides a side frame for a bogie. Two longitudinal sides of the side frame are respectively provided with a supporting seat for connecting an end of a connecting rod, and the supporting seat is integrally formed with the side frame by casting. The supporting seat includes a supporting plate, a middle rib provided underneath a middle portion of the supporting plate, and a first side rib provided underneath a longitudinal inner side of the supporting plate. A middle portion of the supporting plate is provided with a through hole, and the connecting rod is thread-connected to the supporting seat via a conical pole which is fixedly provided in the through hole.

With such a structure, in the operation of the bogie, since the supporting seat is integrally formed with the side frame by casting, errors caused by welding distortion in the prior art is avoided, welding processes are reduced, the installation precision of the supporting seat is ensured and the strength of the supporting seat 1 is enhanced, thereby the motion reliability of the side frame is relative high. The side frame having the above structure can also reduce the production cost of the side frame. For a central cross-braced bogie, since the two connecting rods are crossed at a middle position between the two side frames and are connected with supporting seats 1 of the side frame, a middle portion of and the longitudinal inner side of the supporting seat 1 may be subject to greater forces in the operation of the bogie. With the above structure, the supporting plate 11 can be supported, at the main stressed portions thereof, by the middle rib 12 and the first side rib 13, therefore the strength and operation reliability of the supporting seat 1 are enhanced. Moreover, since the connecting rod and the supporting seat 1 are connected via threads and the conical pole, the connection reliability of the connecting rod can be ensured, and processes of assembling and disassembling are simple and convenient.

The present application further provides a bogie including two pairs of wheels, two side frames provided on two transverse sides of the two pairs of wheels and a bolster mounted between the two side frames, among which the side frame is the side frame as described above.

Since the above mentioned side frame can provide the above technical effects, the bogie including the side frame can also provide the same technical effects, the description of which is therefore omitted for simplicity.

Figure 1:
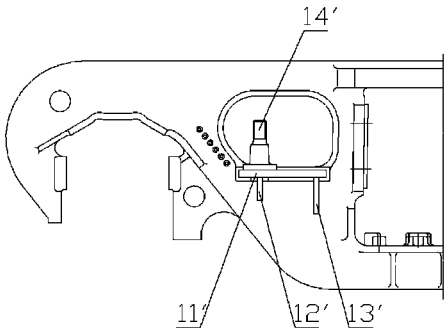
FIG. 1 is a front view of a side frame of a three-piece bogie in the prior art.
Figure 2:
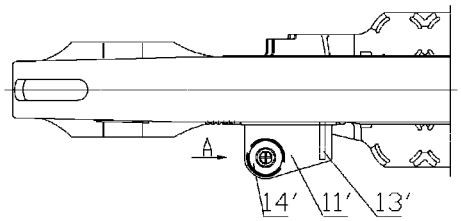
FIG. 2 is a top view of FIG. 1.
Figure 3:
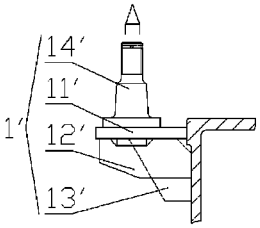
FIG. 3 is a structural schematic view of a supporting seat in FIG. 1.

Correspondence relationships between reference numerals in FIGS. 1 to 3 and the components are as follows:

| | | |
|---|---|---|
| 1' supporting seat; | 11' supporting plate; | 12' first vertical plate; |
| 13' second vertical plate; | 14' conical pole; and | |

correspondence relationships between reference numerals in FIGS. 4 to 6 and the components are as follows:

| | | |
|---|---|---|
| 1. supporting seat, | 11. supporting plate, | 12. middle rib, |
| 121. bottom surface of the middle rib, | | 13. first side rib, |
| 131. bottom surface of the first side rib, 14. second side rib; 15. round plate, | | |
| 151. through hole, | 2. bracket, | 21. horizontal plate, 22. vertical plate. |

DETAILED DESCRIPTION OF THE INVENTION

An aspect of the present application is to provide a side frame for a bogie. The side frame is integrally formed thereon with a supporting seat by casting, thereby the installation precision and strength of the side frame is improved, and thus the motion reliability of the bogie is improved. On basis of this, another aspect of the present application is to provide a bogie with the above side frame.

In order to facilitate those skilled in the art to better understand technical solutions of the present application, the present application will be explained in detail in conjunction with the accompanying drawings and the embodiments.

It is to be noted that noun of locality "longitudinal" and "transverse" used herein refer to the length direction and the width direction of the track when the bogie is parked on a railway track, respectively. That is, herein, the term "longitudinal" refers to the direction in FIG. 4 extended from left to right, the term "transverse" refers to the direction in FIG. 4 extended perpendicular to the paper; the term "longitudinal inner side" and "longitudinal outer side" refer to the left side and the right side in FIG. 4, respectively; and the term "transverse inner side" and "transverse outer side" refer to the upper side and the lower side in FIG. 5, respectively. It shall be appreciated that the noun of locality is defined based on the accompanying drawings, which should not be construed as a limitation to the protection scope of the present application.

Figure 4:
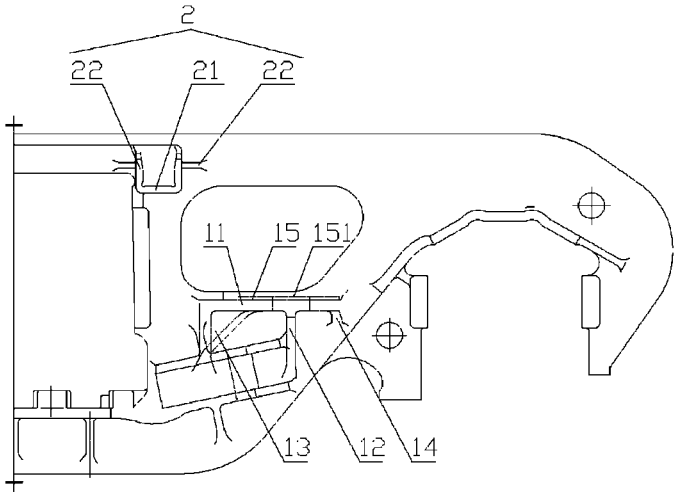
FIG. 4 is a front view of a side frame according to an embodiment of the present application.
Figure 5:
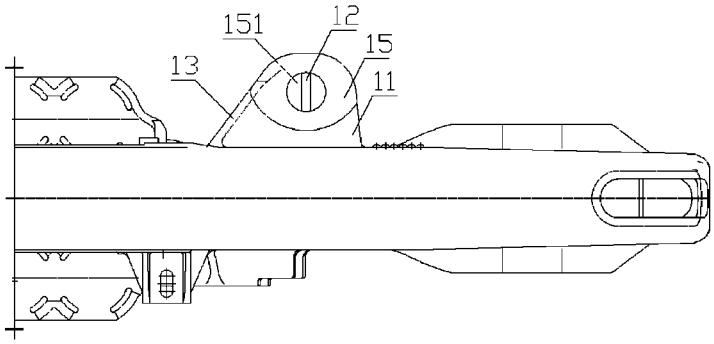
FIG. 5 is a top view of FIG. 4.
Figure 6:
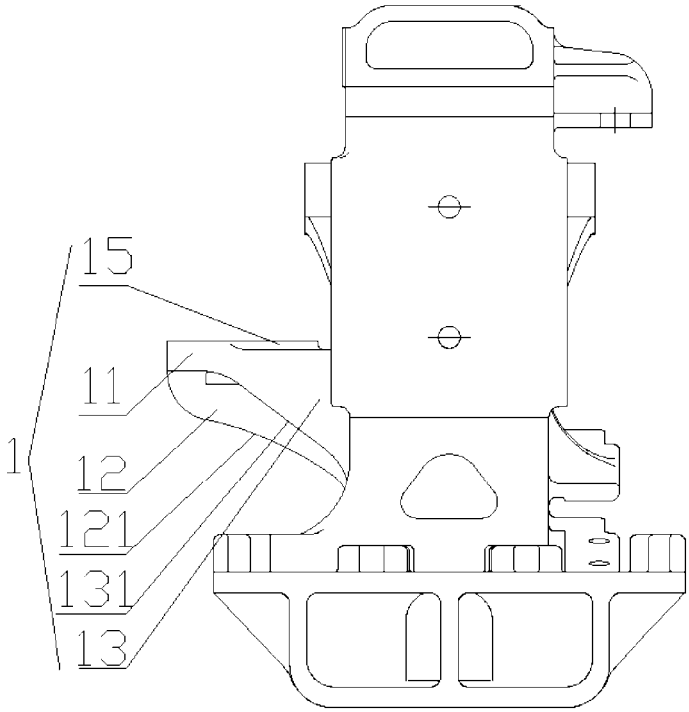
FIG. 6 is a left view of FIG. 4.

Referring to FIGS. 4 to 6, FIG. 4 is a front view of a side frame according to an embodiment of the present application; FIG. 5 is a top view of FIG. 4; and FIG. 6 is a left view of FIG. 4.

As shown in FIGS. 4 to 6, it is provided according to an embodiment of the present application a side frame which is mainly applicable to a central cross-braced bogie. The central cross-braced bogie includes two pairs of wheels, two side frames are provided on two transverse sides of the two pairs of wheels, and a bolster is connected between the two side frames. The bogie further includes two connecting rods which are passed through holes on two sides of the abdominal portion of the bolster in a cross manner, and each of two longitudinal sides of the side frame is provided with a supporting seat 1 which is integrally formed with the side frame by casting for connecting ends of the connecting rods. The two connecting rods and the supporting seat 1 constitute the central cross-bracing structure of the bogie, which acts as a supporting component for the bogie during the operation of the bogie, so as to avoid a parallelogram phenomenon among the two side frames and the two pairs of wheels. As shown in FIGS. 4 and 5, the supporting seat 1 may include a supporting plate 11, a middle rib 12 provided underneath a middle portion of the supporting plate 11, and a first side rib 13 provided under a longitudinal inner side of the supporting plate 11. The supporting plate 11 is provided with a through hole 151 at a middle position thereon, and the connecting rod is thread-connected to the supporting seat 1 through a conical pole provided in the through hole 151.

With such a structure, in the operation of the bogie, since the supporting seat 1 is integrally formed with the side frame by casting, errors caused by welding distortion in the prior art can be avoided, welding processes are reduced, installation precision of the supporting seat 1 is ensured and strength of the supporting seat 1 is enhanced, thereby the bogie has a high motion reliability. Furthermore, through calculation, compared with a supporting seat 1 provided by welding, the supporting seat 1 integrally formed by casting can lower the cost by 200 Yuan, and the weight can be reduced by 10 kg, thus the cost is further reduced by 150 Yuan. In this way, the side frame having the above structure can reduce the production cost of the side frame. For a central cross-braced bogie, since the two connecting rods are crossed at a middle position between the two side frames and are connected to the supporting seats 1 of the side frame, the middle portion and the longitudinal inner side of the supporting seat 1 suffer larger forces in the operation of the bogie. With the above structure, the supporting plate 11 can be supported by the middle rib 12 and the first side rib 13 at main stressed portions of the supporting seat 1, therefore strength and operation reliability of the supporting seat 1 are enhanced. Moreover, the connecting rod is thread-connected to the supporting seat 1 via the conical pole, which can ensure the connection reliability of the connecting rod, and processes of assembling and disassembling are simple and convenient.

It is expected that the supporting seat is not limited to the above structure. For example, in order to further enhance the strength of the supporting seat 1, a second side rib 14 may be further provided under a longitudinal outer side of the supporting seat 1; and the connecting rod may be connected to the supporting seat 1 in connection manners other than the conical pole.

The structure of the above supporting seat 1 may be further configured.

In another embodiment, the supporting plate 11 is tapered along its length from its root portion to its end portion. The first side rib 13 has the same extending direction as that of the longitudinal inner side of the supporting plate 11, and the first side rib 13 is supported under an edge of the longitudinal inner side of the supporting plate 11.

With such a structure, the supporting plate 11 having a shape varied along the length and the first side rib 13 facilitate the casting process of the supporting seat 1 and the side frame. Since the extending direction of the supporting plate 11 is coincided with that of the first side rib 13, the strength and operation reliability of the supporting seat 1 is further ensured.

Based on the above solutions, the extending direction of the longitudinal inner side of the supporting plate 11 and the extending direction of the first side rib 13 are parallel with the direction of the connecting rod connected to the supporting seat 1. In this way, a direction of a force exerted on the side frame by the connecting rod is substantially parallel with a declined direction of the supporting plate 11, resulting in that the force exerted on the side frame by the supporting seat 1 being more reasonable, and it further prevents the supporting seat 1 from being damaged because of being pulled for a long term, thereby the service life of the supporting seat 1 is prolonged.

In a further solution, the end portion of the supporting plate 11 is provided with a round plate 15, and the through hole 151 for mounting the conical pole is provided on the round plate 15.

With such a structure, the round plate 15 has a shape substantially the same with a shape of a bottom surface of the conical pole mounted on the supporting plate, which facilitates to improve the supporting reliability of the supporting seat 1 for the conical pole. Of course, the end portion of the supporting plate 11 may have other shapes such as rectangle, square and the like.

In another embodiment, a bottom surface 121 of the middle rib 12 and a bottom surface 131 of the first side rib 13 are both inclined surfaces.

With such a structure, compared with the structure of the prior art in which each of the bottom surface of the middle rib 12 and the bottom surface of the first side rib 13 includes two inclined surfaces, the middle rib 12 and the first side rib 13, each of which has one inclined surface, have simpler and smoother curves, which further facilitates the casting process and in which the exerted force is reasonable.

In another embodiment, the supporting seat 1 may be provided at a transverse outer side or a transverse inner side of the side frame. The supporting seat 1 may also be provided at an upper side or a lower side of the side frame.

The supporting seats 1 provided at various positions as mentioned above can achieve the connection between the connecting rod and the side frame, thereby the motion reliability of the bogie is ensured. The user may make a choice according to actual needs.

In another embodiment, the bogie further includes a cross beam extended across the two side frames, and an upper end portion of each side frame is provided with a bracket 2 which is connected to an end of the cross beam for supporting the cross beam, and thus the operation stability of the side frame is further enhanced.

The bracket 2 includes a horizontal plate 21 and vertical plates 22 provided at two sides of the horizontal plate 21. The bracket 2 is integrally formed with the side frame by casting.

Similar to technical effects of the supporting seat 1 integrally formed by casting, the bracket 2 integrally formed by casting can enhance the strength of the bracket 2 and ensure the installation precision of the bracket 2, thus improving the motion reliability of the bogie.

It is further provided according to the present application a bogie including two pairs of wheels, two side frames provided on two sides of the two pairs of wheels and a bolster mounted between the two side frames, among which the side frame is the side frame as described above.

Since the above mentioned side frame can provide the above technical effects, the bogie including the side frame can also provide the same technical effects, the description of which is therefore omitted for simplicity.

A bogie and a side frame thereof provided according to the present application are described in detail in the above. Herein, specific examples are employed to explain the principle and embodiments of the present application. The description of the above embodiments is only used to facilitate the understanding of the method of the present application and the idea thereof. It should be noted that, various improvements and modifications may be made by those skilled in the art without departing from the principle of the present application, and these improvements and modifications should also fall within the protection scopes defined by the claims.

What is claimed is:

1. A side frame for a bogie, wherein two longitudinal sides of each side frame are respectively provided with a supporting seat and the supporting seat is integrally formed with the side frame by casting;

the supporting seat comprises a supporting plate, a middle rib provided underneath a middle portion of the supporting plate, and a first side rib provided underneath a longitudinal inner side of the supporting plate; and the supporting plate is provided, on a middle portion thereof, with a through hole; and the supporting plate is tapered along its length from a root portion to an end portion; and the first side rib has the same extending direction as that of a longitudinal inner side of the supporting plate, and is supported under an edge of the longitudinal inner side of the supporting plate.

2. The side frame for the bogie according to claim 1, wherein the extending direction of the longitudinal inner side of the supporting plate is parallel with the extending direction of the first side rib.

3. The side frame for the bogie according to claim 2, wherein the end portion of the supporting plate is provided with a round plate, and the through hole is provided on the round plate.

4. The side frame for the bogie according to claim 3, wherein the bogie further comprises a cross beam extended across the two side frames, and an upper end portion of each side frame is provided with a bracket which is connected to an end portion of the cross beam.

5. The side frame for the bogie according to claim 2, wherein a bottom surface of the middle rib and a bottom surface of the first side rib are both inclined surfaces.

6. The side frame for the bogie according to claim 5, wherein the bogie further comprises a cross beam extended across the two side frames, and an upper end portion of each side frame is provided with a bracket which is connected to an end portion of the cross beam.

7. The side frame for the bogie according to claim 2, wherein the bogie further comprises a cross beam extended across the two side frames, and an upper end portion of each side frame is provided with a bracket which is connected to an end portion of the cross beam.

8. The side frame for the bogie according to claim 1, wherein the supporting seat is provided at a transverse outer side or a transverse inner side of the side frame, or is provided at an upper side or a lower side of the side frame.

9. The side frame for the bogie according to claim 8, wherein the bogie further comprises a cross beam extended across the two side frames, and an upper end portion of each side frame is provided with a bracket which is connected to an end portion of the cross beam.

10. The side frame for the bogie according to claim 1, wherein the bogie further comprises a cross beam extended across the two side frames, and an upper end portion of each side frame is provided with a bracket which is connected to an end portion of the cross beam.

11. The side frame for the bogie according to claim 10, wherein the bracket comprises a horizontal plate and vertical plates provided at two sides of the horizontal bracket, and the bracket is integrally formed with the side frame by casting.

12. A bogie comprising two side frames, wherein the side frame is the side frame according to claim 1.

* * * * *